US007870854B2

(12) United States Patent
Lau et al.

(10) Patent No.: US 7,870,854 B2
(45) Date of Patent: Jan. 18, 2011

(54) CLOSED-LOOP CONTROL SYSTEM FOR HEATING SYSTEMS

(75) Inventors: George H. K. Lau, Vancouver (CA); Robert A. Little, Vancouver (CA); Gordon Arthur Lloyd Coutts, Burnaby (CA); Davinder Gopal Lal, Abbotsford (CA); Chi Ming Gavin Tham, Vancouver (CA)

(73) Assignee: FPI Fireplace Products International Ltd, Delta, British Columbia (CA)

( * ) Notice: Subject to any disclaimer, the term of this patent is extended or adjusted under 35 U.S.C. 154(b) by 115 days.

(21) Appl. No.: 12/047,055

(22) Filed: Mar. 12, 2008

(65) Prior Publication Data

US 2009/0013985 A1 Jan. 15, 2009

Related U.S. Application Data

(60) Provisional application No. 60/894,411, filed on Mar. 12, 2007.

(51) Int. Cl.
*F23N 1/00* (2006.01)
*F23N 5/00* (2006.01)
*G05D 23/19* (2006.01)

(52) U.S. Cl. ..... 126/73; 126/67; 126/502; 126/503; 126/504; 110/101 C; 110/341; 236/1 C; 236/1 E; 236/10; 236/15 BD

(58) Field of Classification Search ..... 126/67, 126/73, 502–504; 110/297, 341, 101 C; 236/1 A, 1 C, 1 E, 10, 11, 15 R, 15 BA, 15 BB, 236/15 BD
See application file for complete search history.

(56) References Cited

U.S. PATENT DOCUMENTS

| | | | | | |
|---|---|---|---|---|---|
| 4,141,336 | A | * | 2/1979 | Fitch | 126/502 |
| 4,264,297 | A | * | 4/1981 | Van Berkum | 431/76 |
| 4,423,487 | A | * | 12/1983 | Buckenham et al. | 702/182 |
| 4,517,902 | A | * | 5/1985 | Christian | 110/190 |
| 4,749,122 | A | * | 6/1988 | Shriver et al. | 236/14 |
| 4,885,573 | A | * | 12/1989 | Fry et al. | 340/519 |
| 4,922,889 | A | * | 5/1990 | Nuesmeyer et al. | 126/73 |
| 5,001,993 | A | * | 3/1991 | Gramlow | 110/233 |
| 5,044,288 | A | * | 9/1991 | Barlow | 110/346 |

(Continued)

FOREIGN PATENT DOCUMENTS

JP 02223722 A * 9/1990

(Continued)

*Primary Examiner*—Steven B McAllister
*Assistant Examiner*—Daniel E Namay
(74) *Attorney, Agent, or Firm*—Snell & Wilmer L.L.P.

(57) ABSTRACT

An exemplary heating system can be configured with a control system configured for controlling the heating system to reduce inefficiencies, and/or allow the heating system to operate in a relatively optimum manner. In accordance with an exemplary embodiment, a closed-loop control system may be configured to control various portions of the heating system based, at least in part, upon signals and/or information received from various sensors of the heating system. For example, among various other types of information provided within a closed-loop feedback, control may be configured based upon the pressure within the combustion chamber. In accordance with another exemplary embodiment, the closed-loop control system may determine a portion of the heating system is not operating properly, based at least in part upon feedback from one or more sensors configured within the heating system.

17 Claims, 4 Drawing Sheets

U.S. PATENT DOCUMENTS

| | | | | |
|---|---|---|---|---|
| 5,123,360 | A * | 6/1992 | Burke et al. | 110/233 |
| 5,277,134 | A * | 1/1994 | Schlessing et al. | 110/188 |
| 5,285,738 | A * | 2/1994 | Cullen | 110/233 |
| 5,359,945 | A * | 11/1994 | Buckner et al. | 110/233 |
| 5,917,138 | A * | 6/1999 | Taylor | 96/61 |
| 5,922,092 | A * | 7/1999 | Taylor | 55/295 |
| 6,216,956 | B1 * | 4/2001 | Ehlers et al. | 236/47 |
| 6,223,737 | B1 * | 5/2001 | Buckner | 126/25 R |
| 6,336,449 | B1 * | 1/2002 | Drisdelle et al. | 126/73 |
| 6,430,904 | B1 * | 8/2002 | Coers et al. | 56/10.3 |
| 6,431,457 | B1 * | 8/2002 | Dirkes, II | 236/11 |
| 7,104,460 | B2 * | 9/2006 | Masen et al. | 236/11 |
| 7,457,689 | B2 * | 11/2008 | Nelson et al. | 700/299 |
| 7,575,398 | B2 * | 8/2009 | Lloyd et al. | 405/232 |
| 2004/0145324 | A1 * | 7/2004 | Ross et al. | 318/254 |
| 2005/0142507 | A1 * | 6/2005 | Sugimoto et al. | 431/7 |
| 2005/0279344 | A1 * | 12/2005 | Cyris | 126/193 |
| 2006/0180459 | A1 * | 8/2006 | Bielenberg | 202/131 |
| 2006/0236906 | A1 * | 10/2006 | Buhr et al. | 110/262 |
| 2007/0068511 | A1 * | 3/2007 | Bachinsky et al. | 126/503 |
| 2007/0137537 | A1 * | 6/2007 | Drisdelle et al. | 110/297 |
| 2007/0137538 | A1 * | 6/2007 | Sterr | 110/341 |
| 2007/0157858 | A1 * | 7/2007 | Gagner et al. | 110/102 |
| 2007/0215143 | A1 * | 9/2007 | McCormick et al. | 126/502 |
| 2007/0289589 | A1 * | 12/2007 | McFarland | 126/502 |

FOREIGN PATENT DOCUMENTS

| | | | |
|---|---|---|---|
| JP | 05257544 | A * | 10/1993 |
| JP | 06307627 | A * | 11/1994 |

* cited by examiner

CLOSED-LOOP CONTROL SYSTEM FOR HEATING SYSTEMS

CROSS-REFERENCES TO RELATED APPLICATIONS

This applications claims priority to and benefit of U.S. Provisional Application No. 60/894,411, entitled "Closed-Loop Control System for Heating Stoves" and filed on Mar. 12, 2007.

TECHNICAL FIELD

The present disclosure relates generally to heating systems, and in particular to a closed-loop control system for providing control of various aspects of a heating system, such as fireplaces and stoves.

BACKGROUND

Various heating systems, including fireplaces and furnaces for home installations, may have been made available to consumers in recent years with improved control systems. Despite improvements, such heating systems, particularly with respect to stoves, may be limited in the ability to control the heat distribution from the heating system to the area to be heated.

For example, while current heating systems have frequently utilized various techniques to separate the combustion air from the room air, such as direct air venting systems, very little has been done to improve heat transfer and distribution. Furthermore, feedback from the heating system to the operating control system could aid in increasing efficiency of the system. This efficiency may include decreasing the amount of spent, unused fuel, maintaining a generally optimum temperature and determining if various fuel delivery systems are jammed or not working properly, among other variables.

SUMMARY

In accordance with various aspects of exemplary embodiments, an improved heating system comprising a closed-loop control system may be configured to control variables of the heating system, such that the heating system may operate more efficiently. In accordance with an exemplary embodiment, an exemplary heating system may include a heating stove comprising a feed auger or other materials delivery system, an air intake, an exhaust vent, a combustion chamber and the closed-loop control system. The heating system may include various types of heating configurations, such as fireplaces, stoves, furnaces or other like heating systems. The feed auger or other materials delivery system can comprise various configurations for providing fuel to the combustion chamber. The air intake is configured to receive external air into the heating system, while the exhaust vent is configured to exhaust heat from within the heating system. Both the air intake and exhaust vent can be configured in various manners, shapes and sizes for providing the respected air intake and heat exhaust functions. Various other types of heating systems besides stoves, such as fireplaces or furnaces, can also be configured with the closed-loop control system.

In accordance with one aspect of exemplary embodiments, the closed-loop control system may be configured to control various portions of the heating system based, at least in part, upon signals and/or information received from various sensors of the heating system. For example, among various other types of information provided within a closed-loop feedback, control may be configured based upon the pressure within the combustion chamber. In accordance with another exemplary embodiment, the closed-loop control system may determine a portion of the heating system is not operating properly, based at least in part upon feedback from one or more sensors configured within the heating system.

In an exemplary embodiment, various characteristics of the heating system may be manipulated by the closed-loop control system to reduce inefficiencies of the heating system. These inefficiencies may include, but are not limited to, inadequate burning of the fuel, inadequate amount of fuel, operating with different types of renewable fuel, such as wood pellets, wheat, corn, and/or other types of fuel, and/or combinations thereof, and different fuel grades, inefficient heat transfer from the combustion chamber, non-optimal pressure in the combustion chamber, inefficient temperature in the combustion chamber, and/or inefficient amount of ash within the combustion chamber, and/or other inefficiencies, and/or combinations thereof.

BRIEF DESCRIPTION OF THE DRAWINGS

The exemplary embodiments may be described in conjunction with the appended drawing figures in which like numerals denote like elements and.

DETAILED DESCRIPTION

The present disclosure may describe various functional components. It should be appreciated that such functional components may be realized by any number of hardware components, electrical and mechanical, configured to perform the specified functions. In addition, exemplary embodiments may be practiced in any number of heating system contexts, and the heating stoves described herein are merely one exemplary application.

Figure 1A:
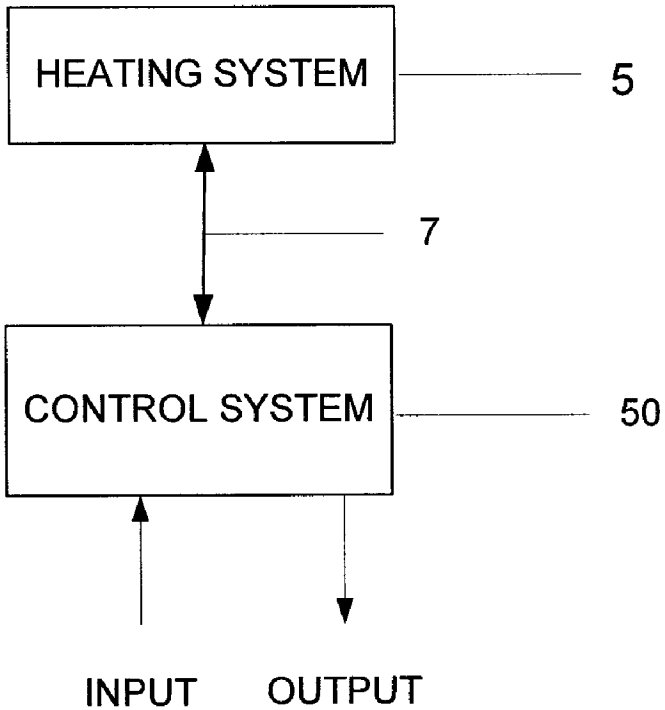
FIG. 1A illustrates a block diagram of an exemplary heating system configured with a control system according to an exemplary embodiment.

Referring now to FIG. 1A, an exemplary heating system 5 is configured with a control system 50 to facilitate control thereof. Heating system 5 may comprise various types of heating configurations, such as fireplaces, stoves, furnaces or other like heating systems. Control system 50 comprises various components and devices configured to control operation of heating system 5, and may be integrated entirely within heating system 5, entirely outside of heating system 5, or any combination of integration within and/or outside of heating system 5. Control system 50 is configured to receive input signals and provide output signals, and to communicate via a communication mechanism 7 to heating device 5. Communication mechanism 7 can comprise wired, wireless or any other system, process or technique for control systems to communicate with systems.

Figure 1B:
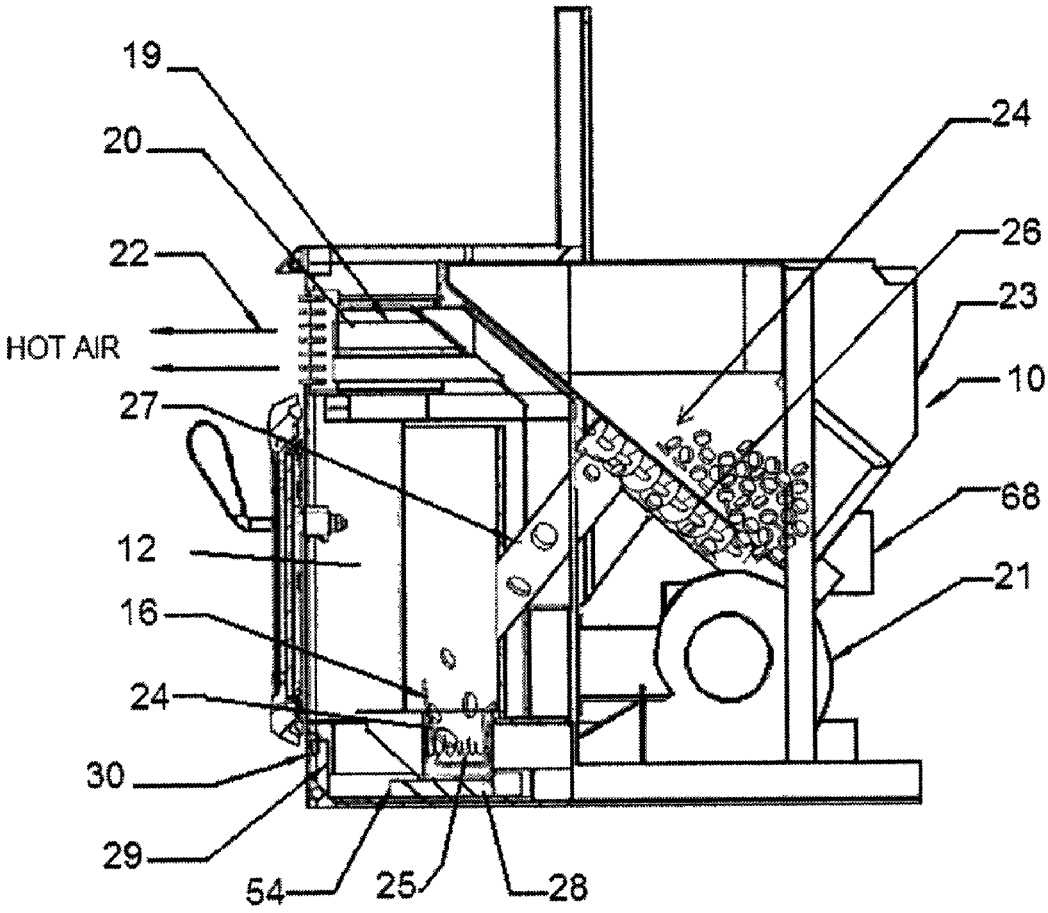
FIG. 1B illustrates a cross-sectional view of an exemplary heating system according to an exemplary embodiment.

In accordance with an exemplary embodiment, with additional reference to FIG. 1B, a heating system 5 comprising a stove system 10 is illustrated. Such illustration is merely for facilitating an understanding of an example system for heating, and can comprise various other types of stoves, as well as fireplaces and/or furnaces, now known or hereinafter devices. In this example, a solid fuel heating device comprising a stove 10 having a combustion chamber 12 is illustrated. In an embodiment, a heat exchange arrangement in the form of hollow pipes 19 can be disposed towards the top end of combustion chamber 12 and may be heated hot air from combustion chamber 12. Ambient air, as indicated by arrows 20, may be circulated through hollow pipes 19 by a fan 21 mounted in a side wall of the heating device, or any other convenient location, such as proximate the hot air exhaust area, to exhaust heated air from pipes 19 into the ambient air, in a direction indicated by arrow 22. This may be accomplished to heat the surrounding area of heating device 10. Fan 21 may be configured in various locations for circulating ambient air through pipes 19, with such pipes 19 being arranged in various manners for discharging heat to the surrounding area.

In an embodiment, the convection and combustion flow system may also be used in other manners by utilizing heat transfer devices to extract heat, including flat and/or accordion plate heat exchangers, air flow passages for exhaust and/or convection air, casting, hot air intake, and/or other methods and systems for discharging heat to the surrounding area. The utilization of heat exchangers with a stove may increase the efficiency of the system, increase the convection temperature, and/or lower the exhaust temperature, and/or combinations thereof.

Furthermore, combustion and convection air flow may be configured to be parallel, counter, and/or cross flow, and/or combinations thereof to further increase efficiency. In an embodiment, heat exchange between the convection and combustion air, heat exchange between the air intake and the exhaust air, mixing the exhaust air with the air intake, etc. may make the system more efficient.

Many different types and configurations of heat exchangers may be utilized with the system. A corrugated surface plate, or a casting made from copper or other high heat transfer coefficient material may be positioned between different air flows to enhance heat transfer. Utilizing finned tubes may further increase the surface area and increase the heat transfer characteristics of the system. Furthermore, the alteration of the air flow devices to create turbulence or other disruption may further increase efficiency.

Other types of heat exchangers, such as heat pipes, or condensers may also be utilized to enhance heat transfer, as they may utilize the phase shifts of fluids to release heat at a much higher rate. Furthermore, there may be other heat exchangers that enhance heat transfer such as coaxial venting, radiator, spiral plated exchangers, and/or any other heat exchanger that may enhance heat transfer.

Heating system 10, as herein illustrated in the exemplary embodiment, may be a biomass pellet, fuel, and/or grain-fed, and/or other fuel, and/or combinations thereof, heating stove. The system may include a "key," which may allow the system to utilize different fuels. The key may be added to allow the use of various types of fuel. The system may allow a user to switch fuel type without shutting down the system.

In an embodiment, heating system 10 may include a hopper 23. Hopper 23 may be configured for storage of fuel sources, such as solid fuel pellets 24, for example. Hopper 23 may be various sizes, shapes, and configurations for storage of fuel. In an exemplary embodiment, fuel pellets 24 may be fed into a fuel bed 25 of combustion chamber 12 by an auger 26 feeding a chute 27.

In the exemplary embodiment, solid fuel pellets 24 entering combustion chamber 12 may be projected into fuel bed 25 by gravity and supported by a support mechanism in the form of a support tray 28. Support tray 28 may be fixedly secured under the bottom, open end of the inner cylindrical wall 16. An ash collecting tray 29 may be removably secured under this support tray 28 and accessible through a door 30. A sensor may be included, which may alert a user that the ash pan is full. This may indicate that the pan should be emptied. If the pan is not emptied, the system may shut down, or other sequence, to protect the system.

Solid fuel pellets and grains (fuel) 24 may also be fed from the bottom or the side of the unit, or any other configuration for providing fuel, and the like, onto fuel bed 25. For example, rather than hopper 23 and/or auger 26, many other mechanisms or systems for conveying materials may be suitably implemented. Heating system 10 may be configured with control system 50 to be capable of operating a high-efficiency burn mode, or a clean burn mode, which may be user selectable.

Figure 2:
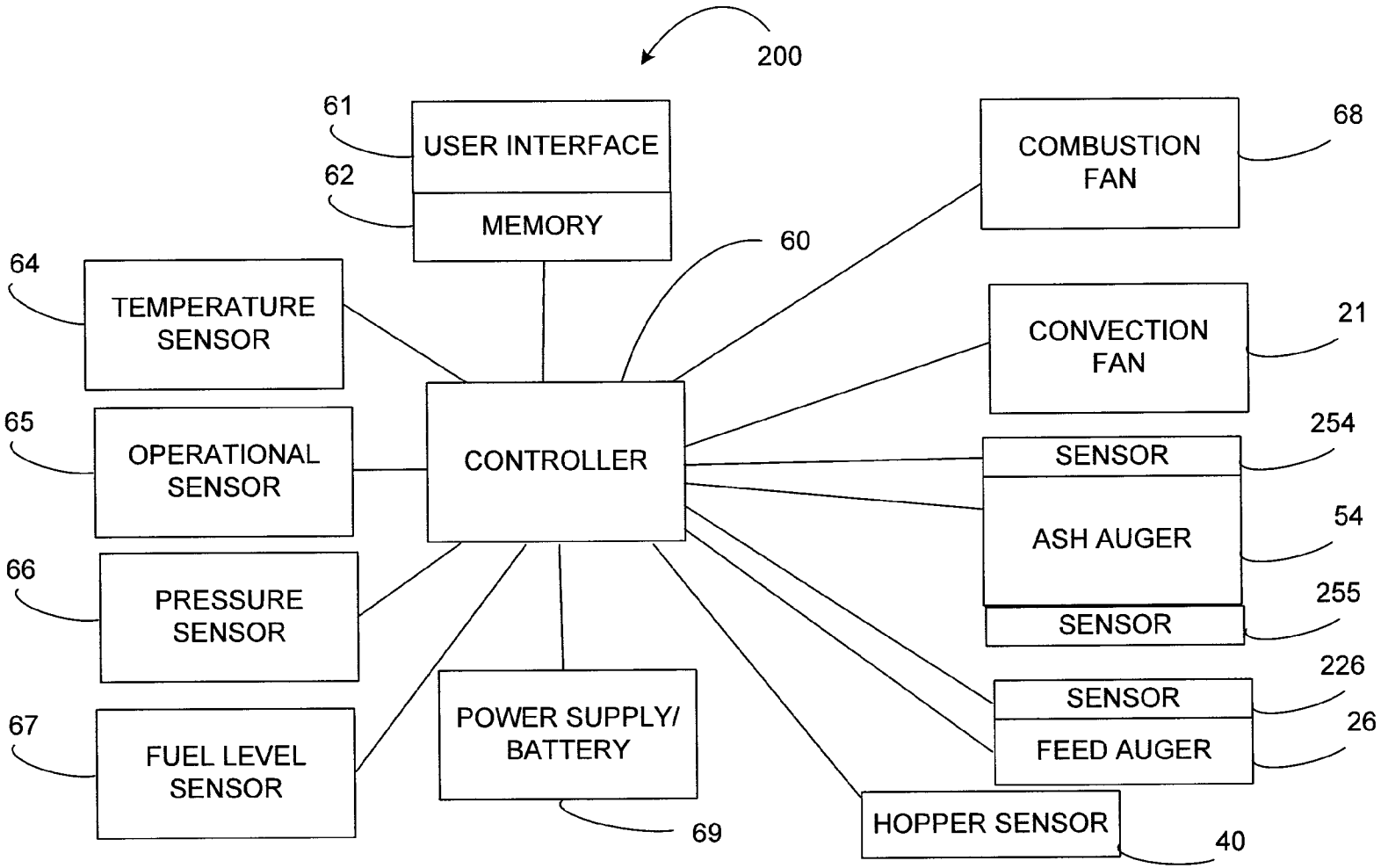
FIG. 2 illustrates a block diagram of an exemplary control system comprising a closed-loop feedback system according to an exemplary embodiment.
Figure 3:
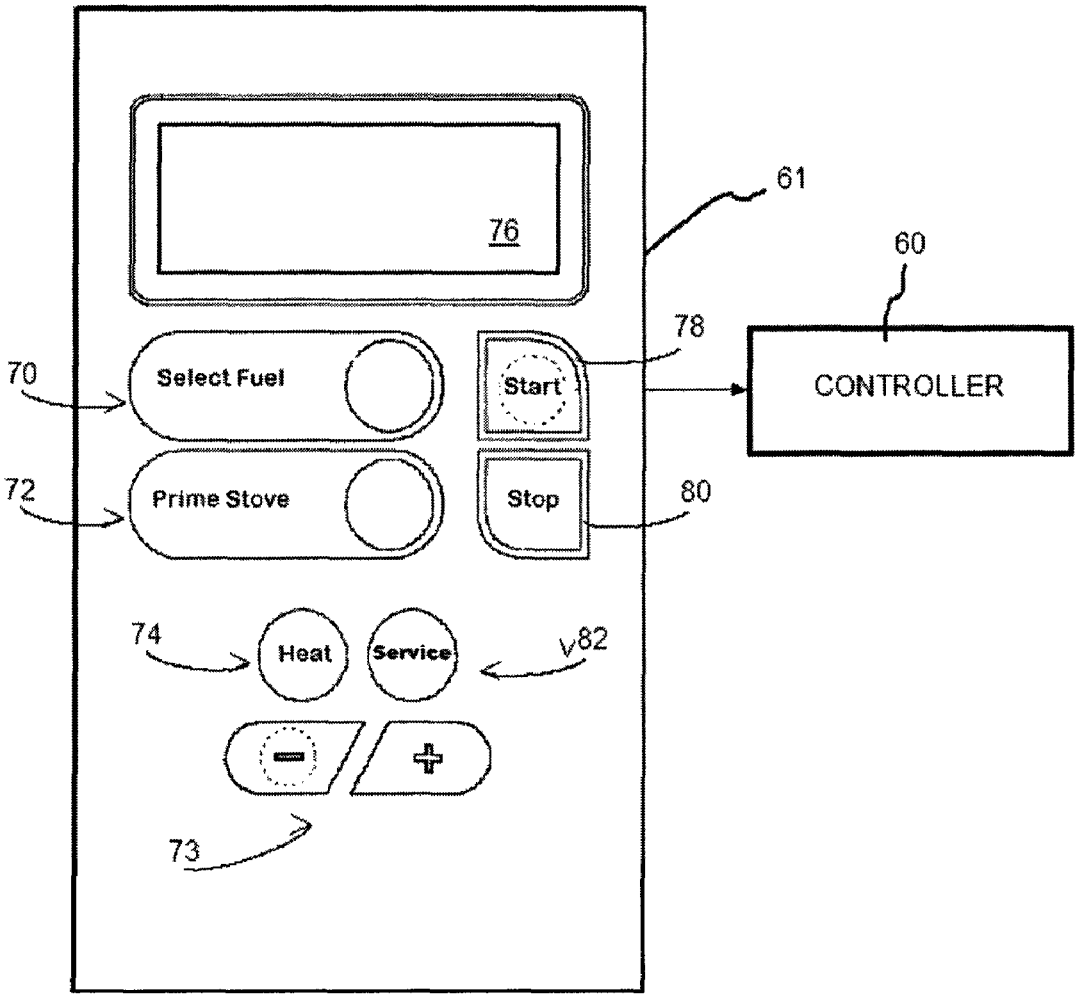
FIG. 3 illustrates a user interface for a control system according to an exemplary embodiment.

With reference to FIG. 2, a block diagram of an exemplary control system 200 comprising a closed-loop control system is illustrated. A closed-loop system comprises, for example, one that provides feedback signals from a heating device to control system 200 to facilitate control of heating system 5. In an embodiment, closed-loop control system 200 may comprise a controller 60 and a user interface 61, which may be provided with an internal memory 62. Controller 60 comprises a processor-based computer and memory, such as used in various other control systems for industrial equipment. User interface 61 may allow a user to input information to controller 60. Furthermore, user interface 61 may allow a user to control certain aspects of control system 200 and thus an exemplary heating system. In an embodiment, user interface 61 may also be capable of transmitting user input, which may condition the controller to operate within a stored programmed mode of operation, depending on the type of fuel being provided to the heating system. Variables such as temperature, type of fuel, and many other variables may be controlled by controller 60 via user interface 61.

In an embodiment, closed-loop control system 200 may include software, hardware, and/or firmware, and/or combinations thereof to control the various aspects of a heating system 5. The software/hardware/firmware may be capable of being upgraded to allow for improved, and/or different modes of operation.

In an embodiment, controller 60 may be provided with input signals from one or more input/output devices to facilitate control of heating system 5. For example, an exemplary control system 200 may comprise one or more sensors, such as a temperature sensor 64, an operational sensor 65, a pressure sensor 66 and/or a fuel sensor 67, and/or any other types of sensors or devices for providing information related to heating system 5. Such sensors are configured in a closed-loop feedback loop to facilitate control of heating system 5 based on various parameters sensed and/or determined by control system 200.

In accordance with an exemplary embodiment, temperature sensor 64 can be provided that senses the temperature of heating device 5. In an embodiment, temperature sensor 64 may be located on a wall of the heating device, and/or other suitable location. Controller 60 may also monitor input signals from an operational sensor 65, such as a thermo sensor, which may be capable of indicating that a flame is present in the heating system, such as within a burner chamber. Temperature sensor 64 may be located on the outside, back wall, and/or other suitable location of combustion chamber 12 to sense the temperature thereof. For example, in a stove application, if temperature sensor 64 detects a predetermined high temperature signal, controller 60 may shut off the fuel feed auger that delivers the fuel to the fuel bed of the fuel burner, thus commencing an orderly automatic shutdown of stove 10. Accordingly, controller 60 may be capable of modulating the operation of the system to maintain a desired temperature output.

In an embodiment, closed-loop control system 200 may include a hopper sensor 40, such as may be used within a stove system 10. Hopper sensor 40 may be capable of detecting the amount of fuel within a hopper. Hopper sensor 40 may be further capable of indicating various levels of fuel in the hopper to controller 60, such that the level may be displayed, and/or an alert may be generated indicating various levels of fuel, such as too low and too high, among many others.

In an embodiment, closed-loop control system 200 may also include a pressure sensor 66, which may be positioned to be capable of measuring the pressure within combustion chamber 12. Controller 60 may receive a signal from pressure sensor 66, which may indicate a pressure level in combustion chamber. There may a particular pressure range, which may generally correspond to a relatively optimal burn conditions for the system. In an embodiment, if the pressure is outside of a range, controller 60 may then control other aspects of the system based at least in part on the pressure. For instance, if the pressure is lower than the optimal range, the controller may increase the combustion fan speed to add more pressure to the combustion chamber, or slow down the feed auger to accommodate pressure drop.

Closed-loop control system 200 may also include a fuel level sensor 67, which may be capable of indicating the level of the fuel available to a heating system 5. For example, with a stove 10, sensor 67 may be capable of detecting the amount of fuel within a hopper. Sensor 67 may be further capable of indicating various levels of fuel in the hopper to controller 60, such that the level may be displayed, and/or an alert may be generated indicating various levels of fuel, such as too low and too high, among many others. Controller 60 may receive a signal from fuel level sensor, and indicate via user interface 61, or other method or system, the fuel level, and/or high or low levels of fuel available. In the embodiment shown in FIG. 1B, the level, and/or high and low levels of the solid fuel may be measured and indicated.

In an exemplary embodiment, such as, for example, one that may be used with stove 10, controller 60 may also be capable of controlling the speed of combustion fan 68, which may be located within heating device 10 as illustrated in FIG. 1B, or otherwise outside, or in in-flow communication, to facilitate intake and exhaust air. Controller 60 may also control the speed of convection fan 21, which may be used to force the air through heat exchangers 19.

In accordance with an embodiment configured with stove 10, controller 60 may also control ash auger 54, which may be capable of evacuating the ashes depending on the operating parameters of the system and high or low ash fuel type. In an embodiment, the closed-loop control system may include a sensor 254, which may be capable of measuring the speed of ash auger 54 and/or operation of ash auger 54. Alternatively, sensor 254 may indicate whether or not ash auger 54 is moving. If controller 60 is sending a signal for ash auger 54 to run, and sensor 254 indicates that ash auger 54 is operating abnormally, or not at all, this may indicate to controller 60 that the ash auger system is not operating properly. Controller 60 may then control heating system 200 to insure that no damage is done, either to the system or to the surrounding area. The above-mentioned control may include an orderly shutdown of the system, and/or an alarm to alert the user.

The system may also include a content sensor 255, which may be capable of sensing the amount of moisture and/or carbon content within the fuel in the fuel bed to insure the fuel is burnt to a degree to allow the ash auger to remove the fuel. Other sensors may include a sensor capable of detecting and alerting when the system may need to be cleaned and/or serviced, or any other sensors configured for sensing or detecting operational parameters of a heating system.

Similarly, heating system 5 may include a feed auger 26, which may be controlled by controller 60. In an embodiment, feed auger 26 may be configured to provide solid fuel to system 5. In an embodiment, the closed-loop control system may include a sensor 226, which may be capable of measuring the speed of feed auger 26, and/or the presence of fuel in the auger. Alternatively, sensor 226 may indicate whether or not feed auger 26 is moving. If controller 60 is sending a signal for feed auger 26 to run, and sensor 226 indicates that feed auger 26 is operating abnormally, or not at all, this may indicate to controller 60 that the feed auger system is not operating properly. Controller 60 may then control heating system 5 to insure that no damage is done, either to the system or to the surrounding area. The above-mentioned control may include an orderly shutdown of the system, and/or an alarm to alert the user. Furthermore, the controller 60 may insure that no backfire may occur.

Similar sensors may be provided in other areas of the system including, but not limited to, the combustion and convection fans. A power supply 69 may provide power for the controller and interface, which, in an embodiment, may be 12 VDC. In an embodiment, a closed-loop control system may also include a battery backup. The closed-loop control system may also have the capability to change to battery power during a power outage, indicate the power outage, and that the battery is in use. Furthermore, the charge remaining in the battery may also be indicated.

Referring now to FIGS. 1A, 1B, 2, and 3 in accordance with exemplary embodiments, there will be described the operation of an exemplary closed-loop control system. In operation, controller 60 may be coupled to a user interface 61 which may be provided with an internal memory 62 (see FIG. 2). In the exemplary embodiment of FIG. 3, user interface 61 includes a keypad-type configuration, with a display 76. In embodiments, display 76 may be an LED-type display, and/or an LCD-type display. Other display types may be utilized without straying from the concepts disclosed herein.

Furthermore, user interface 61 may be configured to allow a user to control and/or manipulate the operation of the heating device 10, such as the system illustrated in FIG. 1B, or any other type of fireplace, stove or heating system.

Controller 60 may be configured to control the motor(s) and the fans, and inputs and operating parameters utilizing information from the sensors. To start the operation of a stove device 10, a user may actuate the button labeled "Start" 78. This may cause the fuel, e.g., pellets, to be automatically fed to the burner and ignited by an ignition device, to create an initial fuel bed. Other steps may then be accomplished to start the operation of heating system 10, such as starting the system with a fire starter, and/or starting with one fuel and continuing the burn with another fuel. Other ignition methods may be utilized, including utilization of an air pump and an igniter to assist the air flow, and/or more than one ignition source. Furthermore, a user may turn off the heating device by depressing the button labeled "Stop" 80. In an embodiment the "Service" actuator 82 may activate diagnostics for the system. The diagnostics may include tuning the burn to compensate for atmospheric conditions, and/or variations in fuel, and fuel quality. It will be appreciated that the diagnostics of the system may include many other diagnostics.

In an embodiment, the user may select a desired mode of operation of device 10 by inputting desired parameters into the controller by the use of interface pad 61. Interface pad 61 can also be provided with heat level buttons 73, which may control the amount of heat produced by the system. This may increase or decrease the temperature in combustion chamber 12. This increase may cause an increase in the temperature of the heated air released by the heating device through the heat exchanger located above the flame, which may be regulated by a separate fan. All of these operating parameters may be capable of being stepped up or down, to maintain relatively optimum performance levels and/or to decrease inefficiencies of the system, according to the desired heat performance required of the device.

Additionally, an exemplary control system can operate from a remote thermostat to regulate all of these operating parameters based at least in part upon the setting(s) of the thermostat. User interface 61 may also be removed from the system and be used remotely. A "Prime Stove" actuator 72 may be provided, which may be capable of activating a method for priming and starting the heating device. This may be due to the various types and/or qualities of the fuel being utilized. Priming may not be necessary for all fuels, types, and/or qualities.

Inputs from actuators may be sent to the controller, which may regulate the speed of the motor, which drives the ash auger. Control or output temperature control switches 73 may also be provided to set a desired BTU output of the pellet stove. Through the software of the controller, the type of fuel and substantially optimal operating conditions of the device may be regulated and maintained.

User interface 61 may also include a fuel selection button 70, which may be configured to indicate to the controller the fuel that will be used. Different choices for fuel may appear within display 64. The user may then depress "Heat" actuator 74, which may allow a user to adjust the heat level using buttons 73 and/or commence operation of the system. This may allow the controller to control various aspects of the system based at least in part upon the type of fuel being used by the system. In an embodiment, the types of fuel shown are solid fuels. However, other fuels, such as non-solid fuels, may also be utilized.

User interface 61 may be attached to heating system 5 and/or 10, or may be a remote control, and or both. Furthermore, user interface 61 may also be capable of communicating with other devices within the heating environment to further control the operation of the system. In one embodiment, another device may be a temperature sensor that may interface with the system.

The present invention sets forth a control system that is applicable to various heating system applications. It will be understood that the foregoing description is of exemplary embodiments of the invention, and that the invention is not limited to the specific forms shown. Various modifications may be made in the design and arrangement of the elements set forth herein without departing from the spirit and scope of this disclosure. For example, the sensors utilized are not limited to those shown herein. Furthermore, other user interfaces may be utilized as well. May other processors/controllers, as well as sensors may be utilized without straying from the concepts disclosed herein. These and other changes or modifications are intended to be included within the scope of the present invention, as set forth in the following claims.

The invention claimed is:

1. A heating system, comprising:

a fuel input, configured to receive a plurality of fuel types;

a combustion chamber in which fuel is utilized to create heat;

a fuel key; and a controller in electronic communication with said fuel key;

wherein said fuel key is configured to provide said controller with first operating parameters for a first fuel type such that said heating system operates to reduce inefficiencies, wherein said fuel key is configured to provide said controller with second operating parameters for a second fuel type, and wherein said heating system continues to operate during a change from said first fuel type to said second fuel type and said heating system operates to reduce inefficiencies in response to operating with said second fuel type.

2. The heating system according to claim 1, wherein said sensor comprises a pressure sensor capable of measuring pressure within said combustion chamber, and said control system is further configured for controlling one or more variables of said heating system based at least in part upon a measured pressure.

3. The heating system according to claim 2, further comprising a feed auger, wherein one of said variables comprises operation of a feed auger.

4. The heating system according to claim 2, further comprising a combustion fan, wherein one of said variables comprises operation of a combustion fan.

5. The heating system according to claim 2, further comprising an ash auger, wherein one of said variables comprises operation of an ash auger.

6. The heating system according to claim 2, further comprising a user interface capable of providing inputs to said controller to manipulate said one or more variables of said heating system.

7. The heating system according to claim 1, wherein said pressure in said combustion chamber is kept within an optimal pressure range, which is based at least in part upon a type of fuel being utilized and/or atmospheric variables.

8. A residential stove system configured for improved heat distribution to a heating area, comprising:

a fuel input configured to receive a plurality of fuel types;

a combustion chamber configured to receive a plurality of fuels types from said fuel input;

an air intake configured to receive external air into said stove system;

an exhaust vent configured to exhaust heated air produced from within said stove system;

a fuel key configured with operating parameters for one of said plurality of fuel types;

wherein said residential stove system continues to operate during a change from a first fuel type of said plurality of fuel types to a second fuel type of said plurality of fuel types; and a control system configured for receiving operating parameters from said fuel key based on one of said plurality of fuel type and a plurality of input signals from a plurality of sensors configured in a closed-loop feedback arrangement, and configured for controlling said stove system to operate to reduce inefficiencies of said heating system based at least in part upon said input signals, wherein said sensors comprise:

a pressure sensor capable of measuring pressure within said combustion chamber;

a feed auger sensor capable of indicating if a feed auger is operating, and a content sensor configured within said combustion chamber, said content sensor configured to monitor at least one of a moisture content and a carbon content of a fuel within said combustion chamber.

9. The stove system according to claim 8, wherein said control system is further capable of controlling one or more variables of said stove system based at least in part upon a measured pressure, and/or atmospheric variables.

10. The stove system according to claim 9, further comprising a combustion fan, wherein one of said variables comprises operation of said combustion fan.

11. The stove system according to claim 9, further comprising a convection fan, wherein one of said variables comprises operation of said convection fan.

12. The stove system according to claim 9, further comprising an ash auger, wherein one of said variables comprises operation of said ash auger.

13. The stove system according to claim 9, further comprising a user interface capable of providing inputs to said controller to manipulate said one or more variables of said heating system.

14. The heating system according to claim 8, wherein said pressure in said combustion chamber is kept within an optimal pressure range, which is based at least in part upon a type of fuel being utilized.

15. The stove system according to claim 8, wherein said control system comprises a remote control device to provide various operational parameters to enable control of said stove system.

16. The heating system of claim 1, further comprising a content sensor configured within said combustion chamber, said content sensor configured to monitor at least one of a moisture content and a carbon content of said fuel within said combustion chamber.

17. The residential stove system of claim 8, wherein said fuel key is configured to provide said controller with first operating parameters for a first fuel type such that said residential stove system operates to reduce inefficiencies, and wherein said fuel key is configured to provide said controller with second operating parameters for a second fuel type such that said residential stove system continues to operate during a change from said first fuel type to said second fuel type and said residential stove system operates to reduce inefficiencies in response to operating with said second fuel type.

* * * * *